US012319480B2

(12) United States Patent
Ubell

(10) Patent No.: US 12,319,480 B2
(45) Date of Patent: Jun. 3, 2025

(54) INVIOLATE BOX

(71) Applicant: Sunshine Enclosures LLC, New York, NY (US)

(72) Inventor: Edward Ubell, New York, NY (US)

(73) Assignee: Sunshine Enclosures LLC, New York, NY (US)

( * ) Notice: Subject to any disclaimer, the term of this patent is extended or adjusted under 35 U.S.C. 154(b) by 635 days.

(21) Appl. No.: 17/095,793

(22) Filed: Nov. 12, 2020

(65) Prior Publication Data

US 2022/0144507 A1 May 12, 2022

(51) Int. Cl.
*B65D 5/38* (2006.01)
*B65D 50/04* (2006.01)

(52) U.S. Cl.
CPC ..... *B65D 50/046* (2013.01); *B65D 5/38* (2013.01); *B65D 2215/02* (2013.01)

(58) Field of Classification Search
CPC ..... B65D 5/38; B65D 50/46; B65D 2215/00; B65D 2215/02; B65D 2215/06
USPC ..... 229/125.125
See application file for complete search history.

(56) References Cited

U.S. PATENT DOCUMENTS

| | | | | |
|---|---|---|---|---|
| 7,757,843 | B2 * | 7/2010 | Katsis | B65D 50/046 220/345.3 |
| 11,230,405 | B2 * | 1/2022 | Fahlke | B65D 50/046 |
| 11,365,022 | B2 * | 6/2022 | Altman | B65D 43/20 |
| D969,604 | S * | 11/2022 | Ubell | D9/432 |

* cited by examiner

*Primary Examiner* — Nathan J Newhouse
*Assistant Examiner* — Phillip D Schmidt
(74) *Attorney, Agent, or Firm* — Bochner PLLC; Andrew Bochner

(57) ABSTRACT

The inviolate box combines an outer sleeve and an inner tray, with the inner tray configured to fit inside the outer sleeve and the outer sleeve configured to cover the inner tray. The outer sleeve has a primary opening and one or more access openings. The access openings are configured to permit a handler of the inviolate box to press the inner tray via the handler's fingers. The fingers would enter through the access openings to exert a squeeze force onto the inner tray, specifically tray protrusions so that the tray protrusions cease running along the same line as sleeve protrusions, thereby overcoming a locking engagement between the outer sleeve and the inner tray, permitting the inner tray to be moved out of the outer sleeve.

15 Claims, 5 Drawing Sheets

INVIOLATE BOX

BACKGROUND

Delicate objects, pharmaceutical drugs, and cannabis products must be sold in containers that are tamper-proof. It is important that these tamper-proof containers not only resist tampering but provide evidence of having been tampered with. However, the mechanisms to provide these features include tape and adhesives, which leave an undesirable residue on the container, or are made of multiple materials which require additional industrial steps to attach and secure, which increases manufacturing costs. What is worse, these materials are frequently plastic, which is known to pollute the environment.

What is needed is a container which requires no additional parts or materials, resists violation, provides indicators if such violation were to occur, is recyclable and is not aesthetically repulsive after being properly opened.

SUMMARY

The inviolate box combines an outer sleeve and an inner tray, with the inner tray configured to fit inside the outer sleeve and the outer sleeve configured to cover the inner tray. Objects which it is desirable to protect and secure, may be placed in the inner tray. The outer sleeve has a primary opening and one or more access openings. The access openings are configured to permit a handler of the inviolate box to press the inner tray via the handler's fingers. The fingers would enter through the access openings to exert a squeeze force onto the inner tray, specifically tray protrusions so that the tray protrusions cease running along the same line as sleeve protrusions, thereby overcoming a locking engagement between the outer sleeve and the inner tray, permitting the inner tray to be moved out of the outer sleeve.

DETAILED DESCRIPTION

Figure 1:
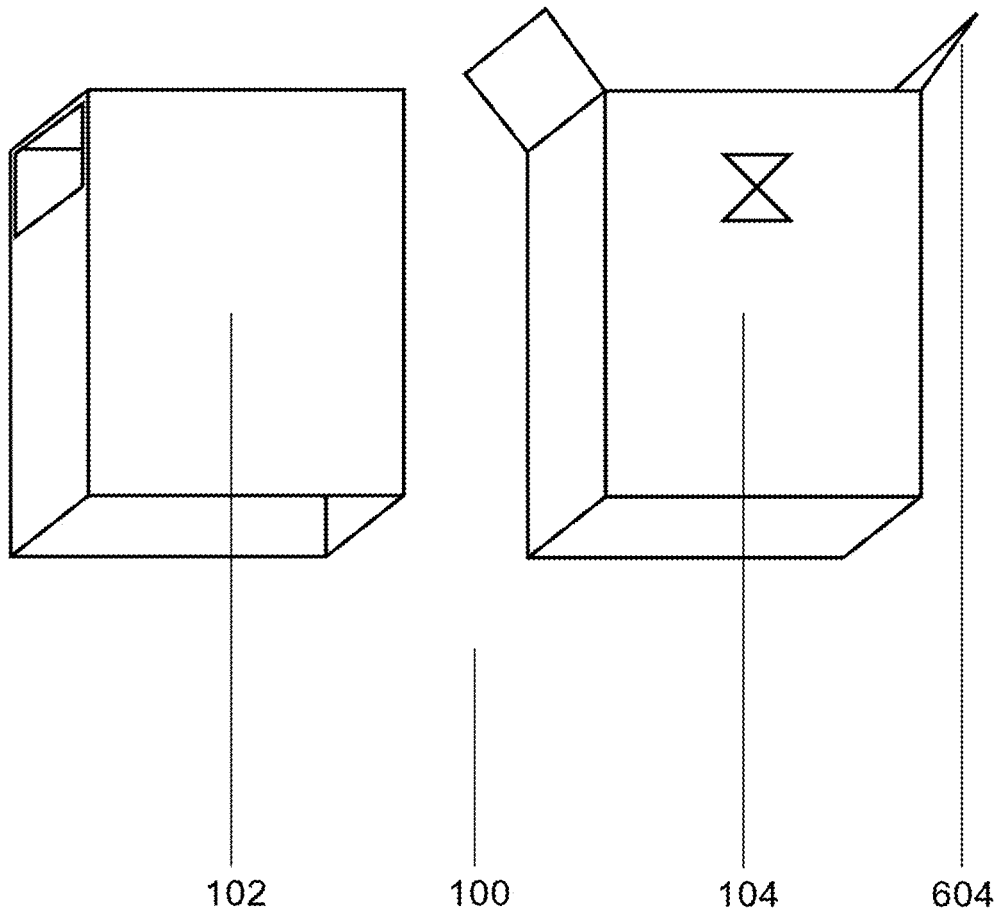
FIG. 1 shows the inviolate box separated into the outer sleeve and the inner tray.

As shown in FIG. 1, the inviolate box 100 may include an outer sleeve 102 and an inner tray 104. The inner tray may be configured to fit inside the outer sleeve, and the outer sleeve configured to cover the inner tray. In addition, the outer sleeve may be designed to "lock together" to prevent the inner tray being removed from the outer sleeve without "unlocking" them. In some embodiments the lock mechanism may operate without the use of any mechanical or electrical lock, clasp, bolt, or other such typical mechanisms. Further, the lock mechanism may operate without the need for tape or glue to provide this locking feature. The involate box and all its parts may be made of a flexible and unassuming material as a rigid paper or cardstock, and relies on a manipulation of the same material in order to lock the outer sleeve to the inner tray. As will be discussed later, these lock mechanisms may include rigid sleeve protrusions (not shown) and rigid tray protrusions 604.

The inner tray may be configured to contain, store, or hold one or more objects, including delicate objects, pharmaceutical drugs, and cannabis products. The inner tray may itself be a box in which these objects are stored within, or may hold the objects in place as a convential tray with insert or vice structures, such that an object may be placed within an outline of the object thermoformed or made as bends in the tray material. The objects may also be taped or otherwise adhered to the tray.

As shown in FIG. 2*a-e,* the outer sleeve may include a first end 206, a middle portion 208, a second end 210, a left wall 212, a right wall 214, a top wall 216, and a bottom wall 218.

Figure 2A:
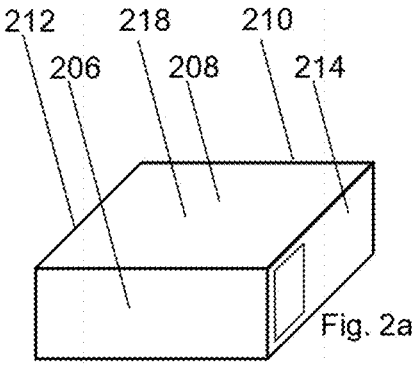
FIG. 2*a* is a perspective view of the outer sleeve showing the first end, the bottom wall, and the right wall.
Figure 2B:
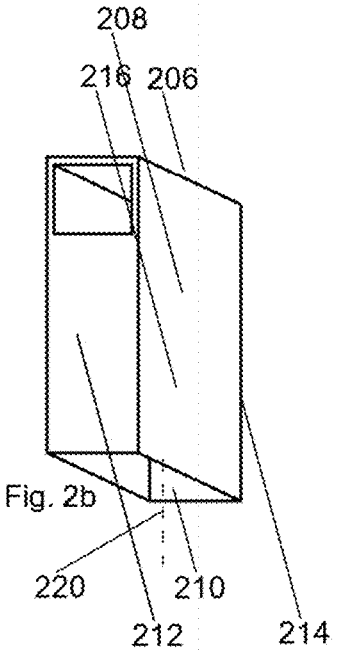
FIG. 2*b* is a perspective view of outer sleeve showing the left wall, top wall, and bottom wall
Figure 2C:
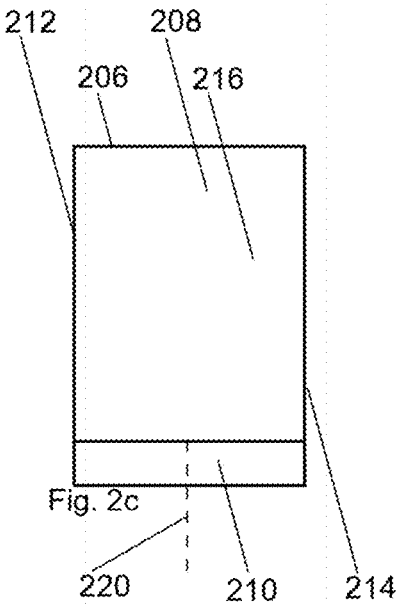
FIG. 2*c* is a perspective view of the outer sleeve showing the top wall and the second end.
Figure 2D:
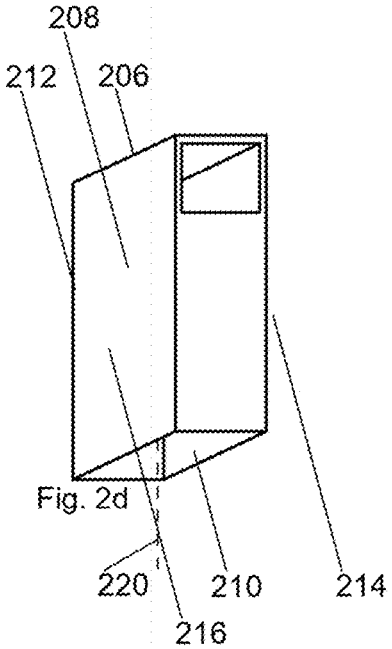
FIG. 2*d* is a perspective view of outer sleeve showing the right wall, the top wall, and the second end.
Figure 2E:
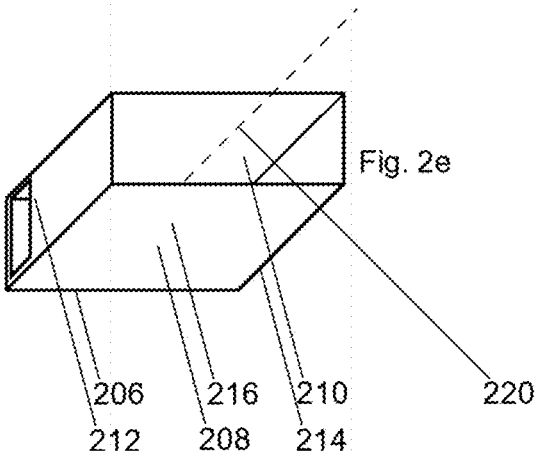
FIG. 2*e* is a perspective view of the outer sleeve showing the second end, the bottom wall, and the left end.

FIG. 2*a* is a perspective view of the first end, bottom wall, and right wall; FIG. 2*b* is a perspective view of the left wall, top wall, and bottom wall; FIG. 2*c* is a perspective view of the top wall and the second end; FIG. 2*d* is a perspective view of the right wall, the top wall, and the second end; FIG. 2*e* is a perspective view of the second end, the bottom wall, and the left wall.

Each of the following outer sleeve pairs may be in parallel and disposed on opposite ends of the middle portion and simultaneously perpendicular to all other pairs: (a) the first and second end, (b) the left and right wall, (c) the top and bottom wall. The outer sleeve may include a central axis 220, conceptually running from the first end to the second end and equidistant from the left wall and the right wall as well as, in some embodiments, equidistant from the top wall and the bottom wall. The outer sleeve may be descriptively divided into one or more lateral sections, which are the slices approximately equal in size and shape to the first end and are orthogonal to the central axis.

Similarly, as shown in FIG. 3*a-e,* the inner tray may also include a first end 306, a middle portion 308, a second end 310, a left wall 312, a right wall 314, a top wall 316, and a bottom wall 318, as well as rigid tray protrusions 604, as will be explained.

Figure 3A:
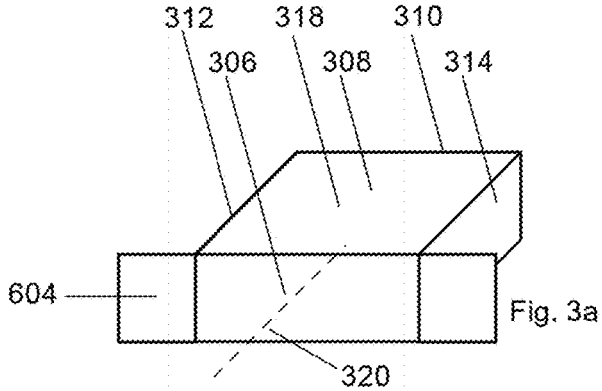
FIG. 3*a* is a perspective view of the inner tray showing the first end, the bottom wall, and the right wall.
Figure 3B:
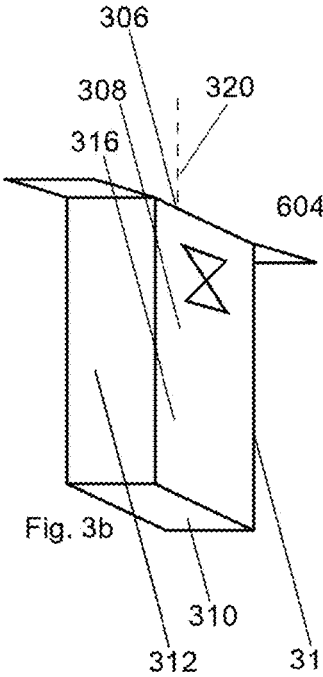
FIG. 3*b* is a perspective view of inner tray showing the left wall, top wall, and bottom wall.
Figure 3C:
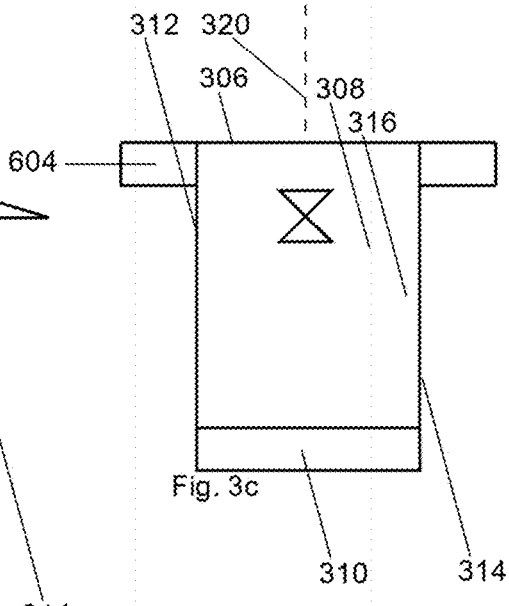
FIG. 3*c* is a perspective view of the inner tray showing the top wall and the second end.
Figure 3D:
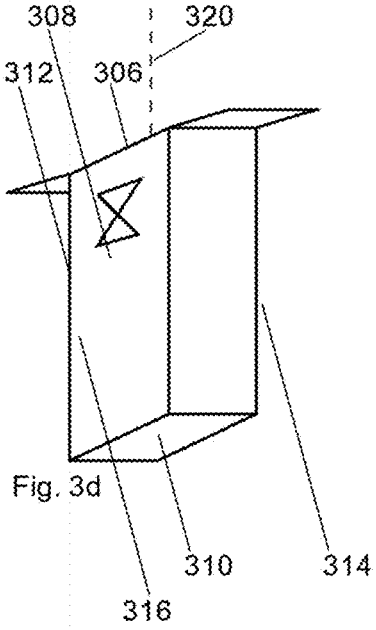
FIG. 3*d* is a perspective view of inner tray showing the right wall, the top wall, and the second end.
Figure 3E:
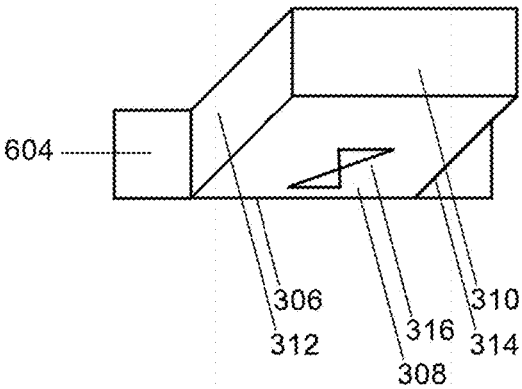
FIG. 3*e* is a perspective view of the inner tray showing the second end, the bottom wall, and the left end.

FIG. 3*a* is a perspective view of the first end, bottom wall, and right wall; FIG. 3*b* is a perspective view of the left wall, top wall, and bottom end; FIG. 3*c* is a perspective view of the top wall and the second end; FIG. 3*d* is a perspective view of the right wall, the top wall, and the second end; FIG. 3*e* is a perspective view of the second end, the bottom wall, and the left end.

Each of the following inner tray pairs may be in parallel and disposed on opposite ends of the middle portion and simultaneously perpendicular to all other pairs: (a) the first and second end, (b) the left and right wall, (c) the top and bottom wall. The inner tray may include a central axis 320, running from the first end to the second end and may be equidistant from the left wall and the right wall as well as equidistant from the top wall and the bottom wall. The inner tray may be divided into one or more lateral sections, which are the slices approximately equal in size and shape to the first end and are orthogonal to the central axis.

In some embodiments, the left and right walls are equal in length to that of the top and bottom walls, but narrower in width. In some embodiments, the left and right walls are equal in length as well as width to those of the top and bottom walls. In certain embodiments, the left and right walls are equal in length to that of the top and bottom walls but wider in width.

Figure 4A:
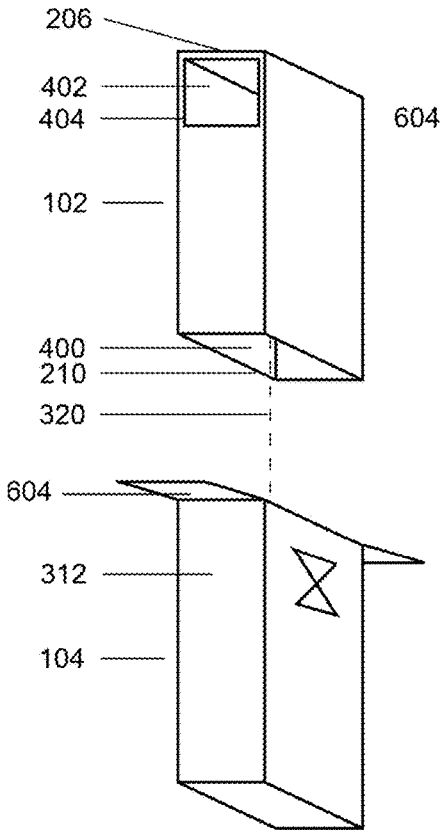
FIG. 4*a* shows the inner tray and outer sleeve aligned before insertion or after removal.
Figure 4B:
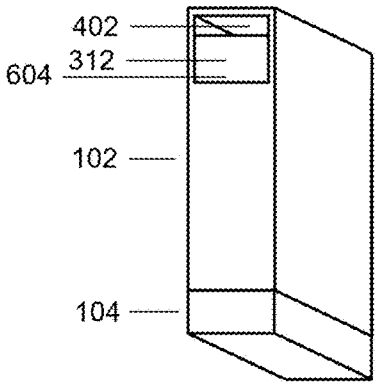
FIG. 4*b* shows the inner tray and outer sleeve with the inner tray incompletely inserted/removed.
Figure 4C:
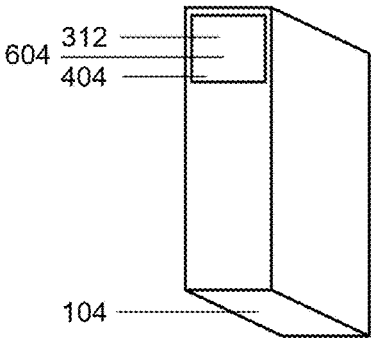
FIG. 4*c* shows the inner tray and the outer sleeve with the inner tray fully inserted/unremoved.

As shown in FIG. 4*a-c,* the central axis 320 of the inner tray 104 may align with the central axis of the outer sleeve 102 when the inner tray is inserted through the a primary opening 400 of the outer sleeve, which is disposed on the second end 210 of the outer sleeve, and into a central cavity 402 of the outer sleeve, which is positioned between the first and second ends, the left and right walls, and the top and bottom walls. Thus, the primary opening may expose the central cavity to an atmosphere external to the outer sleeve and is shaped to receive in a physically flush manner each lateral section of the inner tray.

The outer sleeve may include one or more access openings 404, which are positioned on the left or right set of walls closer to the first end than the second end. These access openings may essentially be cut-outs of the outer sleeve and provide tactile access to the central cavity when the inner tray is not inserted into the outer sleeve. However, when the inner tray is inserted, the access openings may provide tactile access to the left 312 and right set of walls of the inner tray, in particular to the rigid tray protrusions 604, which bend against the left and right set of walls so that they are flush against the same when inside the outer sleeve. The access openings should be sufficiently large to permit a handler of the inviolate box to squeeze the inner tray through the access openings with the handler's fingers, an action which is therefore described as "finger-squeezing", or "unlocking through finger-squeezing" as will be explained later.

Figure 5A:
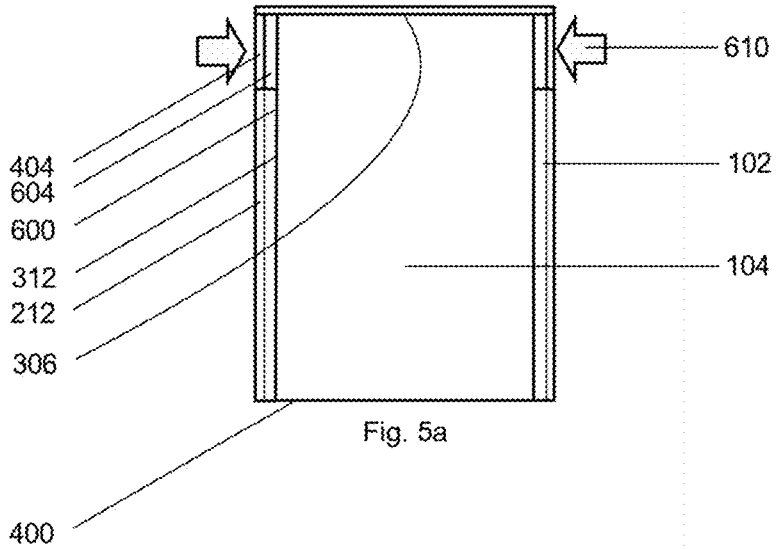
FIG. 5*a* shows the inner tray fully inserted into the outer sleeve prior to force being applied through the access openings, with the rigid tray protrusions locked to the rigid sleeve protrusions.
Figure 5B:
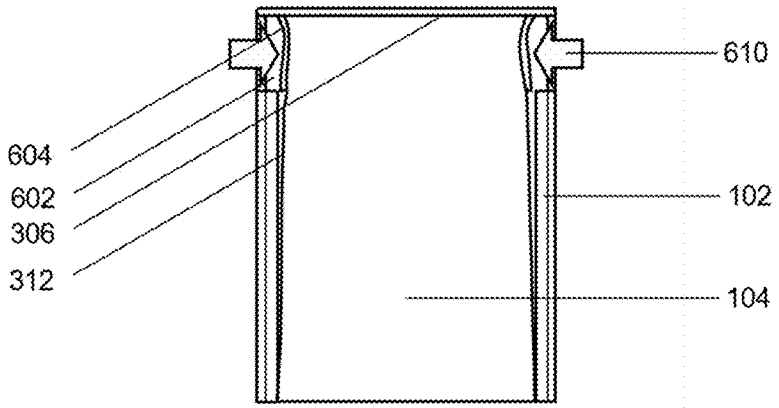
FIG. 5*b* shows the rigid tray protrusions bending in response to force applied through the access windows, thereby unlocking them from the rigid sleeve protrusions.
Figure 5C:
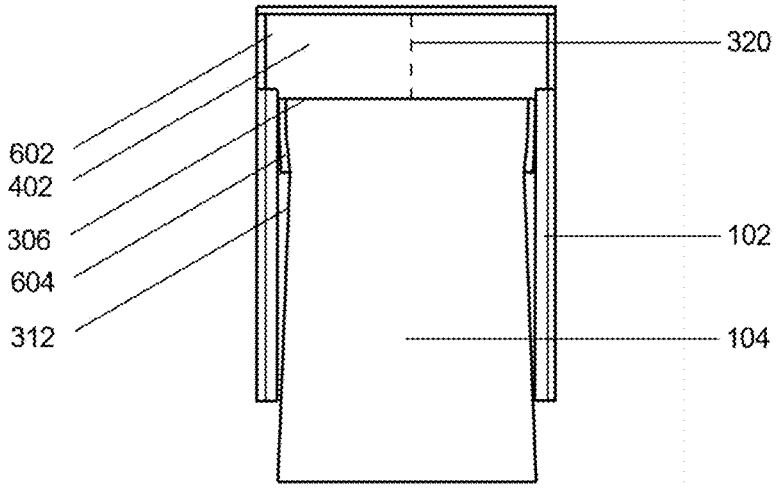
FIG. 5*c* shows the rigid tray protrusions no longer locked to the rigid sleeve protrusions.

As shown in FIG. 5*a-c,* the outer sleeve may include rigid sleeve protrusions 600 which are positioned on the inner surface of the left 212 and right walls of the outer sleeve 102 between the access openings 404 and the primary opening 400 and extend inward toward the central cavity 402. The space 602 between the first end of the outer sleeve and an upper surface of the rigid sleeve protrusions may provide a "locking length" designed to engage with a an approximately equal locking length of rigid tray protrusions 604 of the inner tray, which are positioned on the outer surface of the left 312 and right walls of the inner tray close to the first end 206 of the inner tray and extend outward toward the atmosphere or toward the outer sleeve when the inner tray is inserted into the outer sleeve. Based on their position, the rigid tray protrusions may be capable of tactility access through the access openings, as described earlier.

In certain embodiments, the rigid tray protrusions are attached to the inner tray where the first end meets the left and right walls. In this embodiment, the rigid tray protrusions may not be attached along their "locking lengths" but are hingedly attached or continuous with the first end. In another embodiment, the rigid tray protrusions are attached to the left and right walls along their locking lengths.

The rigid sleeve protrusions are configured to impede the inner tray from being removed from the outer sleeve by blocking the rigid tray protrusions when an attempt is made to pull the inner tray through the primary opening unless, as shown in FIG. 4*a-b,* the rigid tray protrusions are unlocked from the rigid sleeve protrusions through finger-squeezing them 610 toward the central axis of the inner tray.

The thickness of the rigid sleeve protrusions need not be of significant value. The thickness may be equal to a suitable amount, such as equal or up to four times the thickness of the left or right wall of the outer sleeve. Similarly, the thickness of the rigid tray protrusions may also be equal to or up to four times the thickness of the left or right wall of the inner tray. The thickness of the left or right wall of the outer sleeve may be equal to, half the thickness of, or twice the thickness of the left or right wall of the inner tray.

In certain embodiments, there is a gap between the rigid sleeve protrusions and the left and right walls of the outer sleeve, with the rigid tray protrusions inserted into the gap such that the rigid tray protrusions must be torn in order to remove the inner tray from the outer sleeve.

The rigid tray protrusions and rigid sleeve protrusions may be sufficiently rigid such that an intentional force is required to press the rigid tray protrusions toward the central axis of the inner tray, thereby causing some distortion, such as inward bending.

The inviolate box may include an outer sleeve and an inner tray. The inner tray may be configured to fit inside the outer sleeve, and the outer sleeve is configured to cover the inner tray. The outer sleeve and inner tray each may include a first end, a middle portion, a second end, a first set of walls, and a second set of walls, with each of the first and second ends, each of the first set of walls, and each of the second set of walls being disposed on opposite sides of the middle portion, with the first set of walls being parallel to each other but perpendicular to the second set of walls and with both the first and second set of walls being orthogonal to the first and second ends, which are in turn parallel to each other.

The outer sleeve and inner sleeve each may include a central axis running between the first and second set of walls and from the first end to the second end of the outer sleeve. The outer sleeve and inner tray may include lateral sections which are parallel to the first and second ends and to which the central axes are orthogonal. The outer sleeve may include a central cavity positioned between the first and second ends, the first set of walls, and the second set of walls, and a primary opening disposed on the second end. The primary opening may expose the central cavity to an atmosphere external to the outer sleeve and is shaped and sized to match the lateral section of the inner tray such that the inner tray can slide through the primary opening into the central cavity or slide out of the primary opening into the atmosphere.

The outer sleeve may include one or more access openings. The access openings may be positioned on the first set of walls of the outer sleeve and configured to provide tactile access to the first set of walls of the inner tray when the inner tray is disposed inside the outer sleeve, such that the first set of walls of the inner tray can be finger-squeezed toward the central axis of the inner tray through the access openings.

The outer sleeve may include rigid sleeve protrusions positioned on the first set of walls of the outer sleeve between the access openings and the primary opening and extend inward and toward the central cavity. The rigid sleeve protrusions may span from one of the second set of walls to the other wall of the second set of walls of the outer sleeve. The outer sleeve may include first locking lengths, the first locking lengths spanning from the first end of the outer sleeve to upper surfaces of the rigid sleeve protrusions.

The inner tray may include rigid tray protrusions positioned on the first set of walls of the inner tray. The rigid tray protrusions may extend outward and toward the outer sleeve when the inner tray is inserted into the outer sleeve. The rigid tray protrusions may include second locking lengths, the second locking lengths being not more than 105% or less than 95% of the first locking lengths such that the second locking lengths can fit snugly within the first locking lengths. The rigid tray protrusions may be accessible through the access openings when the inner tray is inserted into the outer sleeve. The rigid tray protrusions may be attached to the inner tray where the first end meets the first set of walls or are attached to the first set of walls along their second locking lengths.

The rigid sleeve protrusions may be between 1 to 5 times the thickness of one of the walls in the first set of walls. The rigid tray protrusions may be between 1 to 5 times the thickness of one of the walls in the first set of walls. The left wall of the inner tray may be between half the thickness to twice the thickness of the left wall of the outer sleeve. The rigid sleeve protrusions, rigid tray protrusions, and the left and right walls of the inner tray and the outer sleeve may be formed of the same material. The rigid sleeve protrusions may be configured to impede the inner tray from being removed from the outer sleeve by blocking the rigid tray protrusions when an attempt is made to pull the inner tray through the primary opening, unless the rigid tray protrusions are finger-squeezed through the access openings toward the central axis of the inner tray.

In certain embodiments, such as those disclosed in FIGS. 2-5, the inner tray may be of a suitable width, such as 44 millimeter (mm), 45 mm, or 76 mm, or any suitable variation thereof. It should be noted that, for example, at 76 mm, the inner tray in accordance with the various embodiments may include one wide, or a plurality of, inner storage compartments within the tray. The inner tray may further be formed of any suitable depth, such as, for example 20 mm, and of any suitable height, such, as for example, 104 mm or 143 mm.

In certain embodiments, such as those disclosed in FIGS. 2-5, the outer tray may be of a suitable width, such as 47 mm or 79 mm, or any suitable variation thereof. It should be noted that, for example, at 76 mm, the outer tray in accordance with the various embodiments may be formed over one wide, or a plurality of, inner storage compartments within the inner tray. The outer tray may further be formed of any suitable depth, such as, for example 22 mm, and of any suitable height, such, as for example, 105 mm or 145 mm.

While this invention has been described in conjunction with the embodiments outlined above, many alternatives, modifications and variations will be apparent to those skilled in the art upon reading the foregoing disclosure. Accordingly, the embodiments of the invention, as set forth above, are intended to be illustrative, not limiting. Various changes may be made without departing from the spirit and scope of the invention.

The invention claimed is:

1. An inviolate box comprising an outer sleeve and an inner tray, the inner tray configured to fit inside the outer sleeve, and the outer sleeve configured to cover the inner tray;

a. the outer sleeve having a primary opening and one or more access openings, the access openings configured to provide tactile access through the outer sleeve to the inner tray when the inner tray is disposed inside the outer sleeve;

b. the outer sleeve having rigid sleeve protrusions extending inward;

c. the inner tray having rigid tray protrusions extending outward, each of the rigid tray protrusions formed of rigid planar surface, wherein each rigid planar surface is configured to be flush against a first set of walls when the inner tray is fully inserted into the outer sleeve;

d. the rigid sleeve protrusions configured to impede the inner tray from being removed from the outer sleeve by blocking the rigid tray protrusions when an attempt is made to pull the inner tray through the primary opening unless the rigid tray protrusions are finger-squeezed through the access openings toward a central axis of the inner tray; and e. the outer sleeve and inner tray having a first end, a middle portion, a second end, a first set of walls and a second set of walls, with each of the first and second ends, each of the first set of walls, and each of the second set of walls being disposed on opposite sides of the middle portion, with the first set of walls being parallel to each other but perpendicular to the second set of walls and with both the first and second set of walls being orthogonal to the first and second ends, which are in turn parallel to each other, such that the rigid tray protrusions being attached to the inner tray where the first end meet the first set of walls.

2. The inviolate box of claim 1, wherein each rigid planar surface is a single layer.

3. An inviolate box comprising an outer sleeve and an inner tray, the inner tray configured to fit inside the outer sleeve, and the outer sleeve configured to cover the inner tray;

a. the outer sleeve having a primary opening and one or more access openings, the access openings configured to provide tactile access through the outer sleeve to the inner tray when the inner tray is disposed inside the outer sleeve such that the inner tray can be finger-squeezed;

b. the outer sleeve having rigid sleeve protrusions extending inward;

c. the inner tray having rigid tray protrusions extending outward, each of the rigid tray protrusions formed of a single-layer, rigid, planar surface and wherein each single-layer, rigid, planar surface is configured to be flush against a first set of walls when the inner tray is fully inserted into the outer sleeve;

d. the rigid tray protrusions being accessible through the access openings when the inner tray is inserted into the outer sleeve;

e. the rigid sleeve protrusions configured to impede the inner tray from being removed from the outer sleeve by blocking the rigid tray protrusions when an attempt is made to pull the inner tray through the primary opening unless the rigid tray protrusions are finger-squeezed through the access openings toward a central axis of the inner tray;

f. a left wall of the inner tray being between half the thickness to twice the thickness of the left wall of the outer sleeve; and g. the outer sleeve and inner tray each having a first end, a middle portion, a second end, a first set of walls and a second set of walls, with each of the first and second ends, each of the first set of walls, and each of the second set of walls being disposed on opposite sides of the middle portion, with the first set of walls being parallel to each other but perpendicular to the second set of walls and with both the first and second set of walls being orthogonal to the first and second ends, which are in turn parallel to each other, such that the rigid tray protrusions being attached to the inner tray where the first end meets the first set of walls.

4. The inviolate box of claim 3, the outer sleeve having first locking lengths, the first locking length spanning from a first end of the outer sleeve to upper surfaces of the rigid sleeve protrusions, the rigid tray protrusions each having a second locking length, the first locking lengths configured to engage with the second locking lengths by blocking the rigid tray protrusions with the rigid sleeve protrusions.

5. The inviolate box of claim 4, wherein the second locking lengths are defined by at least a hinged attachment with the first end.

6. The inviolate box of claim 3, the rigid sleeve protrusions, rigid tray protrusions, and the left wall and a right wall of the inner tray and the outer sleeve made of the same material.

7. The inviolate box of claim 3, the rigid sleeve protrusions, rigid tray protrusions, and a left and right walls of the inner tray and the outer sleeve made of paper.

8. The inviolate box of claim 3, the rigid sleeve protrusions, rigid tray protrusions, and a left and right walls of the inner tray and the outer sleeve made of card stock.

9. The inviolate box of claim 3, a second locking lengths being not more than 105% or less than 95% of a first locking length such that the second locking lengths can fit snugly into the first locking lengths.

10. The inviolate box of claim 3, the outer sleeve comprising walls, the rigid sleeve protrusions being between 1 to 5 times the thickness of the walls.

11. The inviolate box of claim 3, the inner tray comprising walls, the rigid tray protrusions being between 1 to 5 times the thickness the walls.

12. The inviolate box of claim 3, the outer sleeve having first locking lengths, the first locking length spanning from a first end of the outer sleeve to upper surfaces of the rigid sleeve protrusions, the rigid tray protrusions each having a second locking length, the first locking lengths configured to engage with the second locking lengths by blocking the rigid tray protrusions with the rigid sleeve protrusions; and the rigid tray protrusions being attached to the first set of walls along their second locking lengths.

13. The inviolate box of claim 3, wherein the access openings are square.

14. An inviolate box comprising:

an outer sleeve and an inner tray, the inner tray configured to fit inside the outer sleeve, and the outer sleeve configured to cover the inner tray;

a. the outer sleeve and inner tray each having a first end, a middle portion, a second end, a first set of walls and a second set of walls, with each of the first and second ends, each of the first set of walls, and each of the second set of walls being disposed on opposite sides of the middle portion, with the first set of walls being parallel to each other but perpendicular to the second set of walls and with both the first and second set of walls being orthogonal to the first and second ends, which are in turn parallel to each other;

b. the outer sleeve and inner tray each having a central axis running between the first and second set of walls and from the first end to the second end of the outer sleeve;

c. the outer sleeve and inner tray having lateral sections which are parallel to the first and second ends and to which the central axes are orthogonal;

d. the outer sleeve having a central cavity positioned between the first and second ends, the first set of walls, and the second set of walls, and a primary opening disposed on the second end, with the primary opening exposing the central cavity to an atmosphere external to the outer sleeve and being shaped and sized to match the lateral section of the inner tray such that the inner tray can slide through the primary opening into the central cavity or slide out of the primary opening into the atmosphere;

e. the outer sleeve having one or more access openings, the access openings positioned on the first set of walls of the outer sleeve and configured to provide tactile access to the first set of walls of the inner tray when the inner tray is disposed inside the outer sleeve such that the first set of walls of the inner tray can be finger-squeezed toward the central axis of the inner tray through the access openings;

f. the outer sleeve having rigid sleeve protrusions positioned on the first set of walls of the outer sleeve between the access openings and the primary opening and extending inward and toward the central cavity;

g. the rigid sleeve protrusions spanning from one of the second set of walls to the other wall of the second set of walls of the outer sleeve;

h. the outer sleeve having first locking lengths, the first locking lengths spanning from the first end of the outer sleeve to upper surfaces of the rigid sleeve protrusions;

i. the inner tray having rigid tray protrusions positioned on the first set of walls of the inner tray and extending outward and toward the outer sleeve when the inner tray is inserted into the outer sleeve, each of the rigid tray protrusions formed of a single planar surface and wherein, when fully inserted into the outer sleeve, each single planar surface is flush against the first set of walls;

j. the rigid tray protrusions having second locking lengths, the second locking lengths being not more than 105% or less than 95% of the first locking lengths such that the second locking lengths can fit snugly within the first locking lengths, wherein the second locking lengths are defined by at least a hinged attachment with the first end;

k. the rigid tray protrusions being accessible through the access openings when the inner tray is inserted into the outer sleeve;

l. the rigid tray protrusions are attached to the inner tray where the first end meets the first set of walls or are attached to the first set of walls along their second locking lengths;

m. the rigid sleeve protrusions being between 1 to 5 times the thickness of one of the walls in the first set of walls of the outer sleeve;

n. the rigid tray protrusions being between 1 to 5 times the thickness of one of the walls in the first set of walls of the inner sleeve;

o. a left wall of the inner tray being between half the thickness to twice the thickness of the left wall of the outer sleeve;

p. the rigid sleeve protrusions, rigid tray protrusions, and the left wall and a right wall of the inner tray and the outer sleeve made of the same material;

q. the rigid sleeve protrusions configured to impede the inner tray from being removed from the outer sleeve by blocking the rigid tray protrusions when an attempt is made to pull the inner tray through the primary opening unless the rigid tray protrusions are finger-squeezed through the access openings toward the central axis of the inner tray.

15. The inviolate box of claim 14, wherein the access openings are square.

* * * * *